United States Patent [19]

Bennett et al.

[11] Patent Number: 4,732,665

[45] Date of Patent: Mar. 22, 1988

[54] HIGH SEVERITY CATALYTIC REFORMING PROCESS

[75] Inventors: Richard W. Bennett, Western Springs; Paul R. Cottrell, Arlington Heights; Norman L. Gilsdorf, Clarendon Hills; Michael D. Winfield, Bloomingdale, all of Ill.

[73] Assignee: UOP Inc., De Plaines, Ill.

[21] Appl. No.: 35,559

[22] Filed: Apr. 6, 1987

Related U.S. Application Data

[63] Continuation-in-part of Ser. No. 813,797, Dec. 27, 1985, abandoned.

[51] Int. Cl.[4] ..... C10G 35/04

[52] U.S. Cl. ..... 208/134; 208/135; 208/48 R; 208/310 R

[58] Field of Search ..... 208/310 F, 310 R, 134, 208/135, 40 R, 65, 99, 255, 299; 585/826, 827, 831

[56] References Cited

U.S. PATENT DOCUMENTS

| | | | |
|---|---|---|---|
| 2,958,644 | 11/1960 | Kimberlin, Jr. et al. | 208/134 X |
| 3,619,407 | 11/1971 | Hendricks et al. | 208/48 R |
| 3,647,680 | 3/1972 | Greenwood et al. | 208/65 |
| 3,793,182 | 2/1974 | Ward | 208/111 |
| 4,129,496 | 12/1978 | Loboda | 208/134 |
| 4,203,825 | 5/1980 | Kmak et al. | 208/134 X |
| 4,447,315 | 5/1984 | Lamb et al. | 208/310 A |
| 4,483,766 | 11/1984 | James, Jr. | 208/134 |

*Primary Examiner*—Helen M. S. Sneed
*Assistant Examiner*—Glenn Caldarola
*Attorney, Agent, or Firm*—Thomas K. McBride; John F. Spears, Jr.; Richard J. Cordovano

[57] ABSTRACT

An improved catalytic reforming process. The process is operated at high severity in order to obtain a reformate product having an enhanced octane rating. Higher octane reformate is required to compensate for the reduction or total elimination of lead-based additives used in motor gasoline for increasing octane rating, since reformate is a primary component of motor gasoline. High severity operation results in the formation of quantities of polycyclic aromatic compounds whose presence is highly undesirable. These compounds are removed from the vaporous products of the catalytic reforming process by adsorption on an appropriate material. It was totally unexpected to find that these very high molecular weight compounds are present in vapor streams comprised of hydrogen and light normally-gaseous hydrocarbons such as methane, ethane, and propane.

3 Claims, 1 Drawing Figure

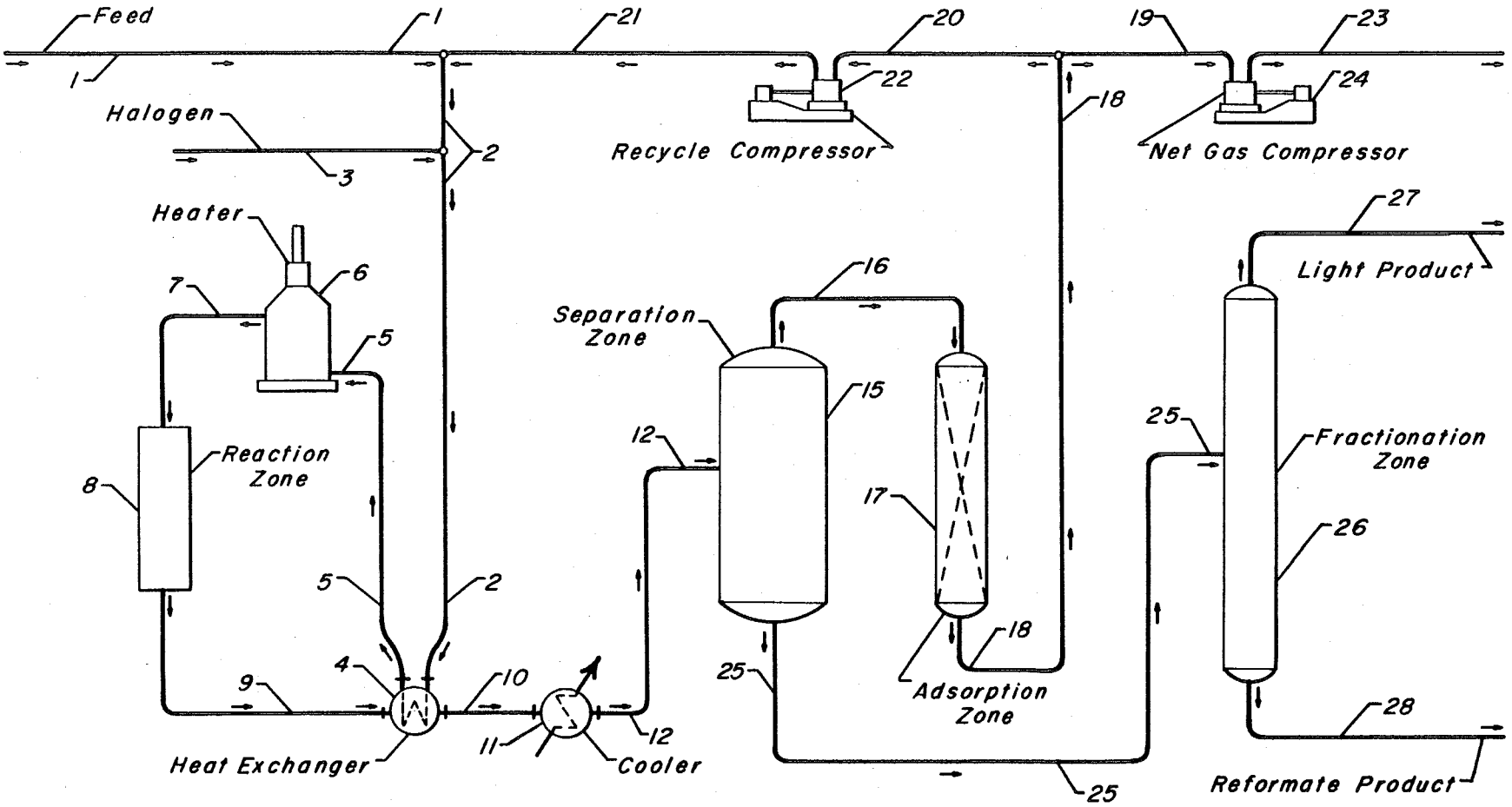
Feed
Halogen
Heater
Reaction Zone
Heat Exchanger
Cooler
Separation Zone
Recycle Compressor
Adsorption Zone
Net Gas Compressor
Fractionation Zone
Light Product
Reformate Product
1
2
3
4
5
6
7
8
9
10
11
12
15
16
17
18
19
20
21
22
23
24
25
26
27
28

HIGH SEVERITY CATALYTIC REFORMING PROCESS

CROSS-REFERENCE TO RELATED APPLICATION

This is a continuation-in-part of U.S. patent application Ser. No. 813,797, filed Dec. 27, 1985, now abandoned.

FIELD OF THE INVENTION

This invention relates to hydrocarbon conversion processes. More specifically, this invention relates to an improved catalytic reforming process, where the improvement deals with removal of undesirable components from the products of a catalytic reforming reaction.

BRIEF SUMMARY OF THE INVENTION

The invention is an improved catalytic reforming process, where the improvement is the recognition that polycyclic aromatic compounds exist in a vapor stream and the removal of such compounds. The process is operated at high severity in order to obtain a reformate product having an enhanced octane rating. Higher octane reformate is required to compensate for the reduction or total elimination of the lead-based additives used in motor gasoline for increasing octane rating, since reformate is a primary component of motor gasoline. High severity operation results in the formation of quantities of polycyclic aromatic compounds whose presence is highly undesirable. These compounds are removed from the vaporous products of the catalytic reforming process by adsorption in an appropriate material. It was totally unexpected to find that these very high molecular weight compounds are present in vapor streams comprised of hydrogen and light normally-gaseous hydrocarbons such as methane, ethane, and propane.

In a broad embodiment, this invention comprises the steps of passing a mixture of a catalytic reforming feed stream and a recycle stream into a catalytic reforming reaction zone which is maintained at high-severity reforming conditions; cooling an effluent stream comprising hydrogen and hydrocarbonaceous catalytic reforming reaction products which is withdrawn from the reaction zone; passing the cooled effluent stream into a vapor-liquid separation zone and recovering therefrom a liquid stream and a hydrogen-rich gas stream; passing the hydrogen-rich gas stream through an adsorption zone wherein the gas is contacted with a treating material which removes polycyclic aromatic compounds from the gas stream, the compounds remaining in the adsorption zone, all of the hydrogen-rich gas stream being substantially free of polycyclic aromatic compounds; mixing a portion of the hydrogen-rich gas stream, which is said recycle stream, with the feed stream to form said mixture and withdrawing the balance of said hydrogen-rich gas stream, which is denoted as net hydrogen, from the catalytic reforming area; and fractionating said liquid stream and recovering an overhead product comprising light hydrocarbons and a bottoms product comprising reformate.

INFORMATION DISCLOSURE

U.S. Pat. No. 4,483,766 (James, Jr.) shows a catalytic reforming process, but does not deal with high-severity operation.

U.S. Pat. No. 4,129,496 (Loboda) deals with a catalytic reforming process where a feed gas is passed through an absorber to remove light paraffins, where the absorbing substance is a liquid hydrocarbon.

U.S. Pat. No. 4,447,315 (Lamb et al.) deals with a hydrocracking process wherein the hydrocarbon feedstock has a propensity to form polynuclear aromatics in the hydrocracking zone. The patent does not recognize the problem addressed by the present invention. Polynuclear aromatics are adsorbed from a liquid stream.

U.S. Pat. No. 2,395,491 (Mavity) discloses a process for separating mononuclear from polynuclear aromatic compounds. The patent does not recognize the problem addressed by the present invention.

In U.S. Pat. No. 2,983,668 (Hemminger), a hydrocarbon conversion reaction is disclosed, wherein a molecular sieve or silica gel is used to separate aromatics or n-paraffins from a reaction mix.

U.S. Pat. No. 3,340,316 (Wackher et al.) and U.S. Pat. No. 3,689,404 (Hofer et al.) deal with separation of hydrocarbons using activated carbon.

BACKGROUND OF THE INVENTION

Petroleum refineries are comprised of numerous reaction systems for effecting conversion of hydrocarbons to a multitudinous number of products. The reactions employed in these systems are usually conducted in the presence of hydrogen and they result in either the net production of hydrogen or the net consumption of hydrogen. Net hydrogen refers to either the hydrogen which is available from a reaction system for use elsewhere or to the hydrogen which must be added to a reaction system from a source outside the reaction system. Because hydrogen is a relatively expensive substance, it has become the practice in the art of hydrocarbon conversion to supply hydrogen from reaction systems which are net producers of hydrogen to systems which are net consumers.

One of the most widely practiced hydrocarbon conversion processes is catalytic reforming. Catalytic reforming is a well established hydrocarbon conversion process employed for improving the octane quality of hydrocarbon feedstocks, the primary product of reforming being motor gasoline. Other products of catalytic reforming comprise light hydrocarbons such as propane and butane. Catalytic reforming is a net hydrogen producing reaction system. The art of catalytic reforming is well known and does not require detailed description herein beyond that required to explain the present invention.

The usual feedstock for catalytic reforming is a petroleum fraction known as naphtha and having an initial boiling point of about 180 degrees Fahrenheit (82° C.) and an end boiling point of about 400 degrees Fahrenheit (204° C.). Catalytic reforming is a vapor phase reaction effected at temperatures ranging from about 500 to about 1050 degrees Fahrenheit (260°–566° C.) and at pressures ranging from about 50 to about 1000 psig (446–6996 kPaa), preferably from about 85 to about 350 psig (687–2515 kPaa). The reaction is carried out in the presence of sufficient hydrogen to provide a hydrogen to hydrocarbon mole ratio of from about 0.5:1 to about 10:1. Further information on catalytic reforming processes may be found in, for example, U.S. Pat. Nos. 4,119,526 (Peters et al.); 4,409,095 (Peters); and 4,440,626 (Winter et al.).

Catalytic reforming is the traditional octane controller in a refinery, that is, the catalytic reforming process is adjusted to vary the octane rating of the reformate product. For example, increasing temperature in a catalytic reforming zone results in a reformate of increased octane rating. Other hydrocarbons are blended with reformate in the production of motor gasoline, but the octane rating of the refinery motor gasoline pool is determined primarily by the octane rating of reformate.

Also, lead-based compounds are added to gasoline in order to enhance octane. The government mandated reduction of lead content of "regular" gasoline and the total elimination of lead in the major portion of gasoline used in this country has caused refiners to look for methods of increasing the octane rating of reformate. One method of reformate octane rating is to increase the severity of the reaction. Increasing reaction temperature increases severity, as does lowering the pressure at which the reaction takes place. Reducing the hydrogen to hydrocarbon ratio also promotes greater severity. It should be noted that increasing the severity of the reaction results in a higher coke make, that is, a higher rate of deposition of coke on the catalyst in the reaction zone. The higher rate of deposition of coke requires more frequent catalyst regeneration.

It can be seen that severity is an umbrella term which covers changes in a number of parameters. Severity is also a relative term and not susceptible of precise definition. Much depends upon the original design of a unit. For example, a refining process operating at higher than design temperature is often said to be operating at an increased severity. Another similar unit operating at the same temperature but where that temperature is the design temperature is often not considered to be operating at higher severity. A change in catalyst or feedstock may induce one skilled in the art to refer to operation at increased severity. For example, in a catalytic reforming unit, a change from the normal feedstock to a thermally cracked naphtha feedstock would normally be considered to be a change to a higher severity operation. Many skilled in the art would consider operation of a catalytic reforming zone at a temperature above about 1020 degrees Fahrenheit (549° C.) to be a high severity process. In a like manner, operating at a pressure below 100 psig (791 kPaa) might be considered to be a high severity process.

Effluent of a catalytic reforming zone, comprising hydrogen and hydrocarbon conversion reaction products, is subjected to processing steps in a separation zone in order to separate it into a hydrogen-rich gaseous stream and a liquid stream. There are numerous methods for effecting the separation; however, the first steps usually comprise cooling the effluent and passing it into a vapor-liquid equilibrium separation vessel, from which a hydrogen-rich vapor phase and a liquid hydrocarbon phase are recovered. Additional steps, often involving recontacting and absorption, may effect further purification of the hydrogen-rich stream, with hydrocarbons separated from the hydrogen-rich stream being combined with the liquid stream. Exemplary methods of processing reforming reaction zone effluent may be found in U.S. Pat. Nos. 3,520,800 (Forbes); 4,364,820 (deGraff et al.); and 4,333,818 (Coste). The hydrogen-rich gaseous stream is usually split into two portions, a first portion which is recycled back to the reaction zone and a second portion which is the net hydrogen stream available for use elsewhere in the refinery. The liquid hydrocarbon phase recovered from the separation zone is usually fed to a fractionation column whose bottoms product is reformate.

There are a number of hydrocarbon conversion reactions which take place in a catalytic reforming zone, including undesirable side reactions. Certain of these undesirable reactions result in the production of polycyclic aromatic compounds, which may be abbreviated PACs. PACs are often referred to as polynuclear aromatic compounds; the term polycyclic will be used herein as it is preferred in the art. A PAC is a hydrocarbon comprising two or more hydrocarbon rings where the rings have at least one carbon atom in common. Further information on PACs may be obtained from a book entitled, "Analytical Chemistry of Polycyclic Aromatic Compounds" (Lee et al., 1981, Academic Press).

The quantity of PACs produced in a catalytic reforming reaction zone increases as severity increases. Thus, as refiners adjust the catalytic reforming process parameters to increase octane rating, they are increasingly suffering operational and maintenance problems due to the presence of higher levels of PACs in catalytic reforming reaction zone effluent. Also, the need for higher octane reformate has resulted in the use of lower quality charge stocks for catalytic reforming. The production of PACs tends to be higher when lower quality stocks such as thermally cracked naphthas, FCC naphthas, hydrocracked naphthas, and coker naphthas are charged to a catalytic reformer. It should also be noted that PACs may be present in the feedstock.

Certainly, PACs have always been present in catalytic reformer effluents. However, the quantities present have been sufficiently small that adverse effects have not been attributed to their presence. Also, it was believed, prior to this invention, that PACs cannot be present in the vaporous products. In some cases, problems resulting from the presence of PACs have been attributed to other causes. The present invention recognizes that PACs are present in the vaporous portion of catalytic reformer effluent, that such presence is the cause of problems in both vapor and liquid phase equipment, and provides a method of dealing with PACs present in the vaporous portion of catalytic reformer effluent.

Since PACs have a high molecular weight, their presence in vapor streams is unexpected and surprising. However, PACs have caused serious problems in vapor phase equipment of catalytic reforming zones. Frequently, the problems were not recognized as being due to PACs, since their presence was unexpected. PACs are frequently seen in the reciprocating compressors which are normally used on the recycle gas stream and the net gas stream. A hard gray material is frequently found on and around the valves and inside the compression chambers. This material causes the valves to stick and prevents them from closing completely. On at least one occasion, a broken compressor shaft was attributed to the material. It is believed that this gray material is comprised of PACs and ammonium chloride salts. Chlorides are usually present in the hydrocarbons in catalytic reforming units. The feedstock to a catalytic reforming unit usually contains combined nitrogen, that is, hydrocarbons having a nitrogen atom. The nitrogen atoms are hydrogenated in the reaction zone and then combine with the chlorides. Ammonium chloride salt deposition is a common problem in a number of different hydrocarbon conversion processes. Of course, deposits of PACs which do not contain salts are also found in compressors.

The reciprocating compressors can be provided with a large amount of lubricant in order to prevent deposition of the gray solids by flushing the material away before it becomes firmly attached to the surfaces and hardens. However, this solution only partially alleviates the problems and, further, simply moves the problem downstream, that is, the deposits occur elsewhere.

In one refinery, PACs and salts in the net gas compressors have been so troublesome that three compressors are installed, each capable of handling 60% of the load. This was done in the expectation of keeping the flow at 60% of capacity when two compressors are inoperative. Normal procedure, in the absence of the problems described, is to install only two compressors.

In another instance, tubes of a heat exchanger used to heat a mixture of feedstock and recycle gas were found to be plugged with an asphalt-like substance. The composition of the plug material was found to be 87% carbon. Aromatic hydrocarbons having up to seven rings were present.

There are numerous other locations in a catalytic reforming unit and associated systems, such as the fuel gas system, where deposition of PACs are capable of causing operational, maintenance, and safety problems, The deposits may be in combination with salts and are often located on relatively cool surfaces. Also, viscous black liquids comprised of PACs have been found in vapor-containing equipment and pipes.

Since a portion of the vapor stream recovered from a catalytic reformer effluent is recycled to the reaction zone and the vapor stream contains PACs, it is believed that the concentration of PACs, in the liquid portion of the reformer effluent is increased.

The presence of PACs in reformate in concentrations above about 50 ppm (by weight) is normally unacceptable. Motor gasoline is usually tested in accordance with ASTM Standard D86. When a sufficient quantity of PACs is present in motor gasoline, the end boiling point detected by the test is too high. The temperature at which 95 percent (by volume) of the sample distills over is usually satisfactory, since the PACs concentrate in the last five percent. However, the end point is 50 to 100 degrees Fahrenheit (10°-38° C.) or more above the 95 percent point. This result may render the gasoline unsaleable. For example, an end point of 500 degrees Fahrenheit (260° C.) is clearly unsatisfactory, while an end point of 430 degrees Fahrenheit (221° C.) is acceptable.

Another problem resulting from the presence of PACs in reformate is the accumulation of a black tarry material, comprised of PACs, in locations in piping and instruments which are not swept clean by the flowing liquid.

As mentioned above, coke deposition on the catalyst is accelerated by operating at high severity conditions. Independent of this effect is an additional increase in the rate of coke deposition which is due to the presence of PACs. The PACs tend to form coke and also to drag other materials down, that is, to promote coke formation by materials other than the PACs.

Thus, it can be seen that removal of PACs in the recycle stream results in benefits in liquid handling pipelines and equipment, as well as on the vapor side.

BRIEF SUMMARY OF THE DRAWING

The Drawing is a schematic representation of equipment used in a catalytic reforming process, including an adsorption zone for removal of polycyclic aromatic compounds.

The Drawing shows only elements essential to a clear understanding of the invention; certain items such as pumps, heat exchangers, surge drums, instrumentation, etc. have been omitted as not essential, the use of such hardward being well within the purview of one skilled in the art.

DETAILED DESCRIPTION OF THE INVENTION

PACs have been found in various locations in the vapor-handling of catalytic reforming units. In a test conducted in a full-scale catalytic reforming unit designed to produce 16,000 barrels per day of reformate, the recycle gas stream (corresponding to the material in pipeline 20 of the Drawing) was passed through a bed of activated alumina. Though the reason for conducting the test was not related to PACs or the problems caused by PACs, samples of alumina from the bed were analyzed for PACs after a period of time in service.

The alumina was heated to drive off hydrocarbons and the vapors were analyzed by high resolution mass spectroscopy. PACs were found in the vapors. Also, alumina samples were washed with chlorobenzene. The chlorobenzene was diluted and analyzed by fluorescence. PACs were detected. PACs could *not* be detected in samples of the recycle gas, though there is no doubt that they were present in the gas stream, since they were found on the alumina.

In another commercial catalytic reforming unit, samples of a hard dry crystalline powder were recovered from the net gas compressor (corresponding to compressor 24 of the Drawing). Also, a brown liquid seeping from an insufficiently-tightened flange in the pipeline feeding the compressor was sampled. Both substances were qualitatively identified as being comprised of 4+ ring PACs by fluorescence analysis.

A residue found in the recycle gas circuit of a third catalytic reforming unit was analyzed. The residue was dissolved in pentane and charged to a column of silica gel. The recovered substance was analyzed by high resolution mass spectroscopy. Aromatics and aromatic oxygenates comprised 96.16% of the residue; these ranged from alkylbenzene to coronenes (7 ring PACs).

The invention will be explained by reference to an exemplary catalytic reforming system, which is depicted by the Drawing. The use of this example is not intended to constitute an undue limitation on the broad scope of the invention as set forth in the claims.

A feedstream in pipleine 1 is combined with a recycle stream in pipeline 21 and the resulting mixture is supplied to heat exchanger 4 by means of pipeline 2. A halogen may be added to the mixture in pipeline 2 by means of pipeline 3. It is necessary that a small concentration of a halogen be present in a catalytic reforming reaction mixture, in addition to being present on the catalyst. Since halogens may be removed along with the PACs in the adsorption zone of the present invention, it is necessary to replace the halogens. Chlorine is the preferred halogen. It may be added in the form of elemental chlorine, hydrogen chloride, and/or an organic chlorohydrocarbon, such as propylene or ethylene dichloride. It should be noted that if a continuous catalyst regeneration system is utilized, where the regeneration process incorporates a chloride addition step, it is not necessary to add the halogen as depicted in the Drawing.

The feed mixture is heated in heat exchanger 4 by removing heat from the reaction zone effluent stream and then supplied to fired heater 6 by pipeline 5. After the feed mixture is heated to a catalytic reforming temperature in the fired heater, it is conveyed to reaction zone 8 by pipeline 7. A catalytic reaction zone normally contains two or more reactors with provisions for reheating the reaction mixture between reactors, since the catalytic reforming reaction is endothermic.

The effluent stream emanating from the reaction zone is conveyed to heat exchanger 4 by pipeline 9, where it is cooled by exchange of heat with incoming feed. It may be necessary to further cool the effluent. If so, cooler 11 is utilized, the effluent being transferred to cooler 11 by means of pipeline 10. Cooled effluent is supplied to vapor-liquid equilibrium separation zone 15 by pipeline 12. Material entering separation zone 15 is separated into a liquid stream and a gas stream comprised primarily of hydrogen and also containing light hydrocarbons. There are numerous schemes for effecting the separation, as mentioned above. Usually, there are several vessels in a vapor-liquid equilibrium separation zone.

The hydrogen-rich gas stream is withdrawn from separation zone 15 and supplied to adsorption zone 17 by means of pipeline 16. In adsorption zone 17, a substantial quantity of the PACs in the effluent stream are removed and retained by the treating material contained in the adsorption zone. Adsorption zone 17 may include two separate adsorption vessels, so that the treating material in one vessel may be regenerated while the other vessel continues to be used in the reforming process. The vaporous product stream from the adsorption zone will be sufficiently free of PACs such that solids deposits and viscous black liquids comprising PACs will not be found in downstream equipment.

The gas stream flowing out of adsorption zone 17 via pipeline 18 is split into two portions, a first portion, denoted the recycle stream, is passed to compressor 22 by means of pipelines 18 and 20. After the gas stream is raised to reforming pressure by the compressor, it is passed through pipeline 21 to be mixed with the feedstream in pipeline 1. Since PACs present in the gas stream have been removed, use of the recycle stream does not result in an increased concentration of PACs in the liquid reformate.

The balance of the hydrogen-rich stream withdrawn from separation zone 15 is the net gas stream, or the net hydrogen, which is used elsewhere in the refinery, as explained above. Net hydrogen is supplied to net gas compressor 24 by means of pipelines 18 and 19 and then routed to points of use outside the catalytic reforming area through pipeline 23.

Liquid is withdrawn from separation zone 15 via pipeline 25 and supplied to fractionation zone 26. The overhead product of fractionation zone 26 is removed from the zone in pipeline 27 and comprises hydrogen and light hydrocarbons such as propane, butane, ethane and methane. The reformate product is withdrawn from fractionation zone 26 in pipeline 28. The reformate has a high octane rating by virtue of the severe operating conditions used in the reforming process.

The treating material used in the absorption zones may comprise activated carbon, silica, activated alumina, activated charcoal, silica-alumina, clay, silica gel, cellulose acetate, synthetic magnesium silicate, and/or macroporous magnesium silicate and macroporous polystyrene gel. It is expected that carbon or charcoal will be the preferred adsorbent.

Operating conditions of the adsorption zones may vary in temperature from about 70 to about 600 degrees Fahrenheit (21°–316° C.). In general, adsorbent capacity increases with increasing temperature, so higher operating temperatures are preferred. The vapor may be re-heated before it is supplied to the adsorption zone and the heat may be recovered in part by exchanging heat between adsorption zone feed and adsorption zone effluent. Adsorption zone pressure may vary from about atmospheric pressure to about 300 psig (2170 kPaa).

It is not necessary to remove all of the PACs in the hydrocarbon streams. For example, it is expected that removal of 70% of the PACs found in the incoming hydrocarbons would alleviate the above-discussed problems resulting from the presence of PACs. When a stream is substantially free of PACs, at least 70% of the PACs originally present are removed.

There are numerous methods of regenerating the treating material; that is, removing PACs from the treating material so that it may be re-used. In one method, the temperature of the bed of adsorbent is altered and hydrocarbons lighter than the PACs are passed through the adsorbers to replace the adsorbed PACs. A benzene wash might be used; the PAC-laden benzene would be disposed of by mixing it with feed to the refinery crude tower. Alternatively, lighter hydrocarbons such as pentanes, butanes, or propanes at desorbing conditions of temperature and pressure may be used. For example, a stream of pentane and isobutane would be a preferred desorbent for activated carbon. Those skilled in the art are able to select appropriate temperatures. The light hydrocarbons would then by recycled, in the same manner as benzene, by adding the PACs and hydrocarbons to the crude stream.

Another regeneration method which may be used when the adsorbent can be subjected to high temperature (for example, alumina) is to burn the PACs, that is, oxidize the PACs to carbon dioxide and water. This method has an advantage in that it is familiar to those operating catalytic reforming units, since the catalyst is regenerated by burning off coke deposits. It may be necessary to pass gas from a burning zone through a wet scrubber to remove undesirable components, such as chlorides.

In certain circumstances, it may be appropriate to dispose of used adsorbent after a single use rather than regenerating it for multiple uses.

We claim as our invention:

1. A high-severity catalytic reforming process comprising:

(a) passing a mixture comprising a catalytic reforming feed stream and a recycle stream into a catalytic reforming reaction zone which is maintained at high-severity reforming conditions;

(b) cooling an effluent stream comprising hydrogen and hydrocarbonaceous catalytic reforming reaction products which is withdrawn from said reaction zone;

(c) passing said cooled effluent stream into a vapor-liquid separation zone and recovering therefrom a liquid stream comprising hydrocarbons and a hydrogen-rich gas stream;

(d) passing said hydrogen-rich gas stream through an adsorption zone wherein said gas is contacted with a treating material which removes polycyclic aromatic compounds from said gas stream, said compounds remaining in the adsorption zone;

(e) mixing a portion of said hydrogen-rich gas stream, which is said recycle stream, with said feed stream to form said charge stock mixture and withdrawing the balance of said hydrogen-rich gas stream, which is denoted as net hydrogen, from the catalytic reforming area, all of said hydrogen-rich gas stream being substantially free of polycyclic aromatic compounds; and (f) fractionating said liquid stream and recovering an overhead product comprising light hydrocarbons and a bottoms product comprising reformate.

2. The process of claim 1 further characterized in that a halogen is added to said mixture of a feed stream and a recycle stream before the mixture enters said reaction zone.

3. The process of claim 1 further characterized in that said treating material is comprised of at least one material selected from a group comprised of activated carbon, silica, activated alumina, activated charcoal, silica-alumina, clay, silica gel, cellulose acetate, synthetic magnesium silicate, macroporous magnesium silicate, and macroporous polystyrene gel.

* * * * *